US006760543B1

(12) United States Patent
Orr et al.

(10) Patent No.: US 6,760,543 B1
(45) Date of Patent: Jul. 6, 2004

(54) HEATED AIR CIRCULATOR WITH UNIFORM EXHAUST AIRFLOW

(75) Inventors: Paul W. Orr, Coatesville, PA (US); Gary S. Beideman, West Chester, PA (US)

(73) Assignee: Lasko Holdings, Inc., Wilmington, DE (US)

( * ) Notice: Subject to any disclaimer, the term of this patent is extended or adjusted under 35 U.S.C. 154(b) by 0 days.

(21) Appl. No.: 10/322,169

(22) Filed: Dec. 18, 2002

(51) Int. Cl.[7] ..... F24H 3/00
(52) U.S. Cl. ..... 392/365; 392/360; 392/368
(58) Field of Search ..... 392/365–369, 392/360, 363, 379–383

(56) References Cited

U.S. PATENT DOCUMENTS

| | | | | | |
|---|---|---|---|---|---|
| 1,429,130 | A | * | 9/1922 | Dutton | 392/365 |
| 2,255,759 | A | * | 9/1941 | Carpenter | 392/363 |
| 2,471,784 | A | * | 5/1949 | Seifner et al. | 392/363 |
| 2,824,429 | A | * | 2/1958 | Zucker | 392/365 |
| 3,175,550 | A | * | 3/1965 | Knapp | 392/365 |
| 3,251,540 | A | * | 5/1966 | Kinsworthy | 392/365 |
| 3,267,255 | A | * | 8/1966 | Schulz | 392/365 |
| 3,290,112 | A | * | 12/1966 | Gillenwater et al. | 392/363 |
| 3,575,582 | A | * | 4/1971 | Covault | 392/369 |
| 3,725,640 | A | * | 4/1973 | Kunz | D23/342 |
| 4,743,739 | A | * | 5/1988 | Tateishi | 392/365 |
| 4,900,898 | A | * | 2/1990 | Kling | 392/503 |
| 5,083,011 | A | * | 1/1992 | Munroe | 392/360 |
| 6,321,034 | B2 | | 11/2001 | Jones-Lawlor et al. | |
| RE37,642 | E | * | 4/2002 | Goldstein | 392/367 |
| 6,480,672 | B1 | | 11/2002 | Rosenzweig et al. | |

FOREIGN PATENT DOCUMENTS

| | | | | |
|---|---|---|---|---|
| DE | 863112 C | | 1/1953 | |
| EP | 0417309 A1 | | 3/1991 | |
| FR | 993168 | * | 10/1911 | 392/367 |
| FR | 1502018 | | 11/1967 | |

* cited by examiner

*Primary Examiner*—John A. Jeffery
(74) *Attorney, Agent, or Firm*—RatnerPrestia

(57) ABSTRACT

An apparatus for providing thermal energy comprising a housing defining a first interior space and a second interior space; at least one electric heating element positioned within the first interior space; and an air circulator positioned within the second interior space and adjacent the first interior space, the air circulator receiving intake air from a first flow path and generating exhaust air along a second flow path, the second flow path substantially orthogonal to the first flow path such that the exhaust air flows through the at least one heating element.

52 Claims, 17 Drawing Sheets

HEATED AIR CIRCULATOR WITH UNIFORM EXHAUST AIRFLOW

FIELD OF THE INVENTION

This invention relates generally to heaters for use in household environments. More specifically, the present invention relates to an elongate heater in which pressurized exhaust air passes through the heater element.

BACKGROUND OF THE INVENTION

Conventional forced hot air heaters for consumer use are well-known and are comprised of an electrical heating element and a fan within a housing. An example of such a conventional heater 600 is shown in FIG. 6. As shown in FIG. 6, air created by axial fan assembly 602 diffuses as it approaches heater element 604. As such, this diffuse air pattern does not flow through all of heater element 604, or flows through heater element 604 at different velocities over the length of heater element 604, thereby resulting in less that satisfactory heating levels felt by the user. This problem is exacerbated if the length of the heater element is increased.

In another conventional elongated heater 700, a portion of which is shown in FIG. 7, transverse air circulator 702 has an elongated blade assembly 704. A drawback of this type of air circulator is that blade assembly 704 of has several sections 706 which must be coupled together by glue or ultrasonic welding. This assembly must then balanced to insure correct operation as well as requires the use of vibration dampers 708, 710. This adds significant expense to the manufacturing process, which translates into a higher retail price to consumers. In addition, the blade assembly in transverse air circulators is long and tends to become misaligned at top bearing 712, thereby requiring a special bearing mounted in a rubber pad to compensate for the misalignment.

There is a need for a forced air electric heater that provides increased comfort levels, provides exhaust air having a more uniform velocity across the surface of the heating element, and is more efficient and inexpensive to manufacture.

There is also a need for a heater construction having a blower assembly with unitary construction which is easily mounted in the heater unit and less expensive to manufacture.

SUMMARY OF THE INVENTION

In view of the shortcomings of the prior art, the present invention is a apparatus and method for providing thermal energy. The apparatus comprises a housing defining a first interior space and a second interior space; at least one electric heating element positioned within the first interior space; and an air circulator positioned within the second interior space and adjacent the first interior space, the air circulator having at least one intake port receiving intake air from a first flow path and generating exhaust air along a second flow path, the second flow path substantially orthogonal to the first flow path such that the exhaust air flows through the at least one heating element.

According to another aspect of the invention, the air circulator has a predetermined blade diameter and the at least one heating element has a predetermined length, and a ratio of the at least one heating element length to the air circulator blade diameter is at least 1.75:1.

According to a further aspect of the invention, the air circulator has at least one fan blade having a plurality of blade elements facing in a rotational direction of the air circulator.

According to still another aspect of the invention, the apparatus comprises a housing defining a first interior space; at least one electric heating element positioned within the first interior space, the at least one electric heating element having a length of at least 7 inches; an air circulator positioned within the housing and in fluid communication with the first interior space, the air circulator generating exhaust air for charging the first interior space with a static pressure; the air circulator having a predetermined blade diameter and the at least one heating element having a predetermined length, a ratio of the heating element length to the air circulator blade diameter being at least 2:1.

According to yet a further aspect of the present invention, a restricting means is provided for restricting a flow of the exhaust air through the heating element, such that the exhaust air from the air circulator flows through the heating element at a substantially uniform velocity.

According to yet another aspect of the present invention, the first interior space forms a plenum area between the heating element and the air circulator.

According to still another aspect of the present invention, the restricting means adjacent to at least one of the input side and the output side of the heating element.

According to a further aspect of the present invention, the restricting means is incorporated within the heating element.

According to yet a further aspect of the present invention, the velocity of the air emanating from the heating element is greater than 375 fpm at 1 foot from at least a portion of the at least one heating element.

According to yet another aspect of the present invention, the air circulator has a predetermined blade diameter and the at least one heating element has a predetermined length, and a ratio of the heating element length to the air circulator blade diameter is at least 2:1.

According to still another aspect of the invention, the restricting means has a flow through area of between 20% and 80%.

According to yet another aspect of the invention, the restricting means converts the static pressure associated with the exhaust air into an air velocity which is in turn imparted into the exhaust air and flows through the at least one heating element.

According to yet a further aspect of the invention, the air circulator is a non-transverse blower.

According to still a further aspect of the invention, the aspect ratio of the heating element is greater than 4:1.

According to yet another aspect of the invention, the aspect ratio of the heating element is about 18:1.

The method comprises the steps of providing a housing having a first interior space and a second interior space; receiving intake air along a first flow path; generating an exhaust airflow within the first interior space along a second flow path based on the intake air, the second flow path substantially orthogonal to the first flow path; generating thermal energy within the first interior space using a thermal energy generator; imparting the thermal energy into the exhaust air by passing the exhaust air though the thermal energy generator to form heated exhaust air; and expelling the heated exhaust air from the first interior space.

These and other aspects of the invention are set forth below with reference to the drawings and the description of exemplary embodiments of the invention.

BRIEF DESCRIPTION OF THE DRAWINGS

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following Figures.

DETAILED DESCRIPTION

Figure 1:
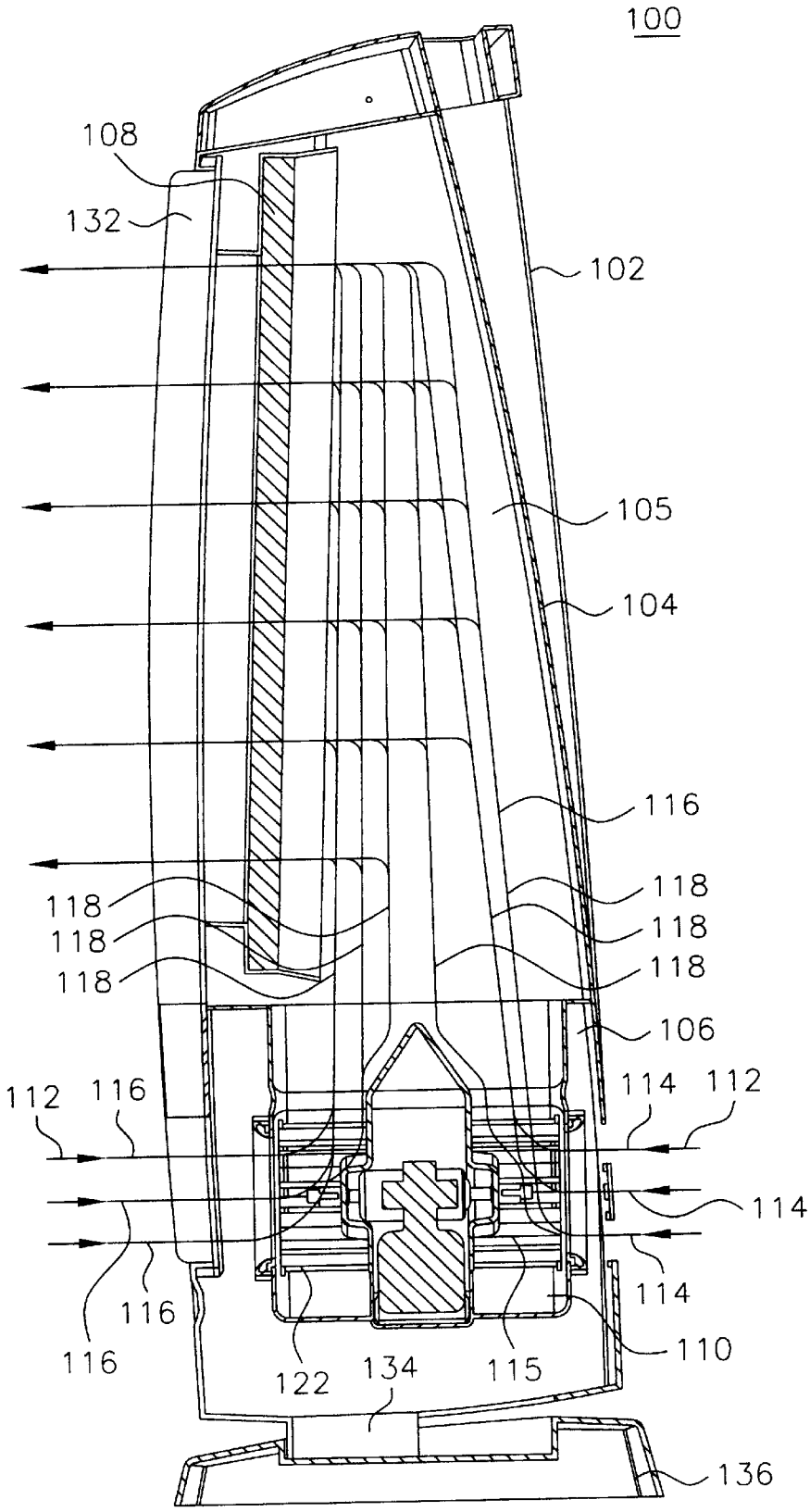
FIG. 1 is a cross-sectional side view of an exemplary embodiment of the present invention.
Figure 2A:
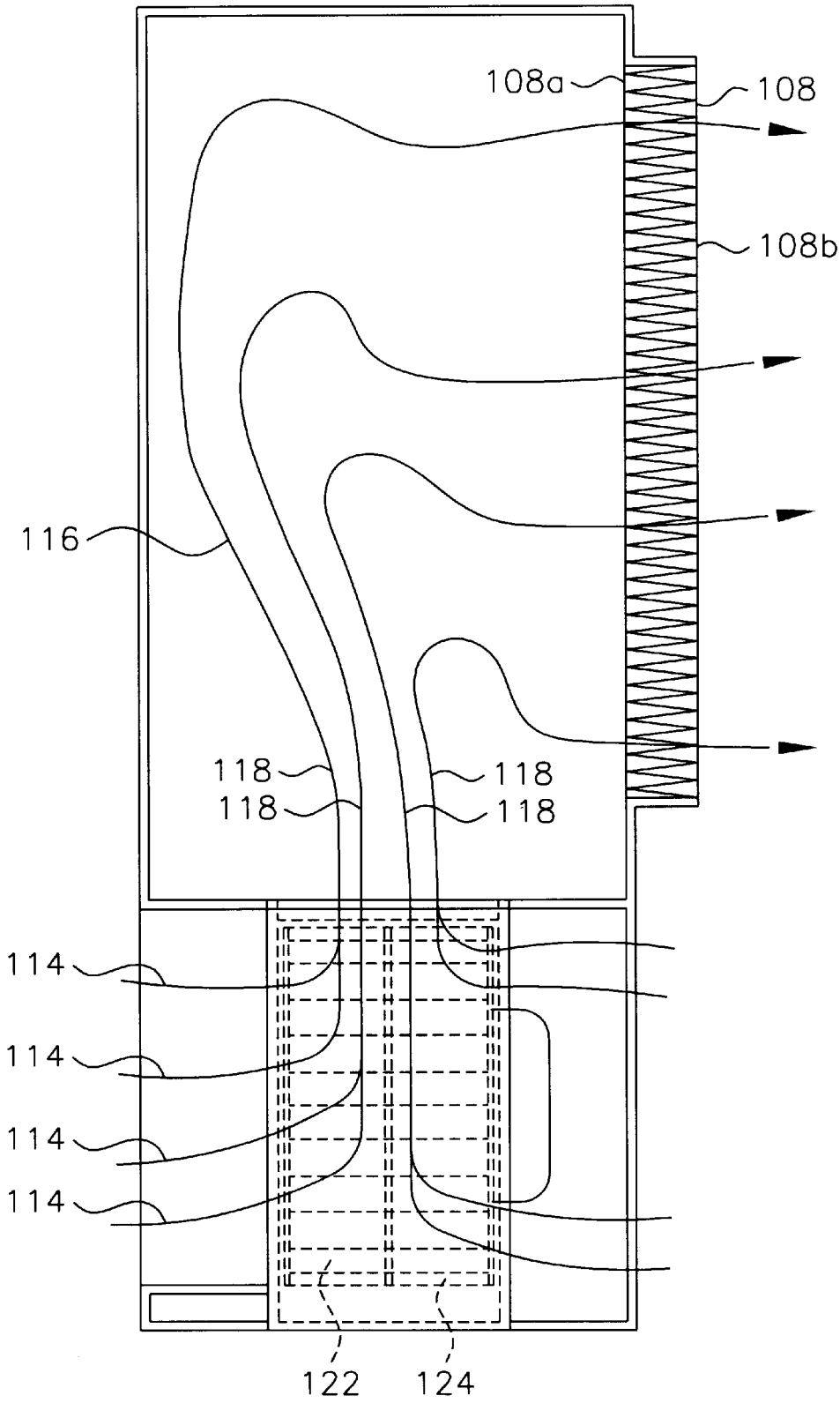
FIGS. 2A and 2B are additional cross sectional views of an exemplary embodiment of FIG. 1.
Figure 2B:
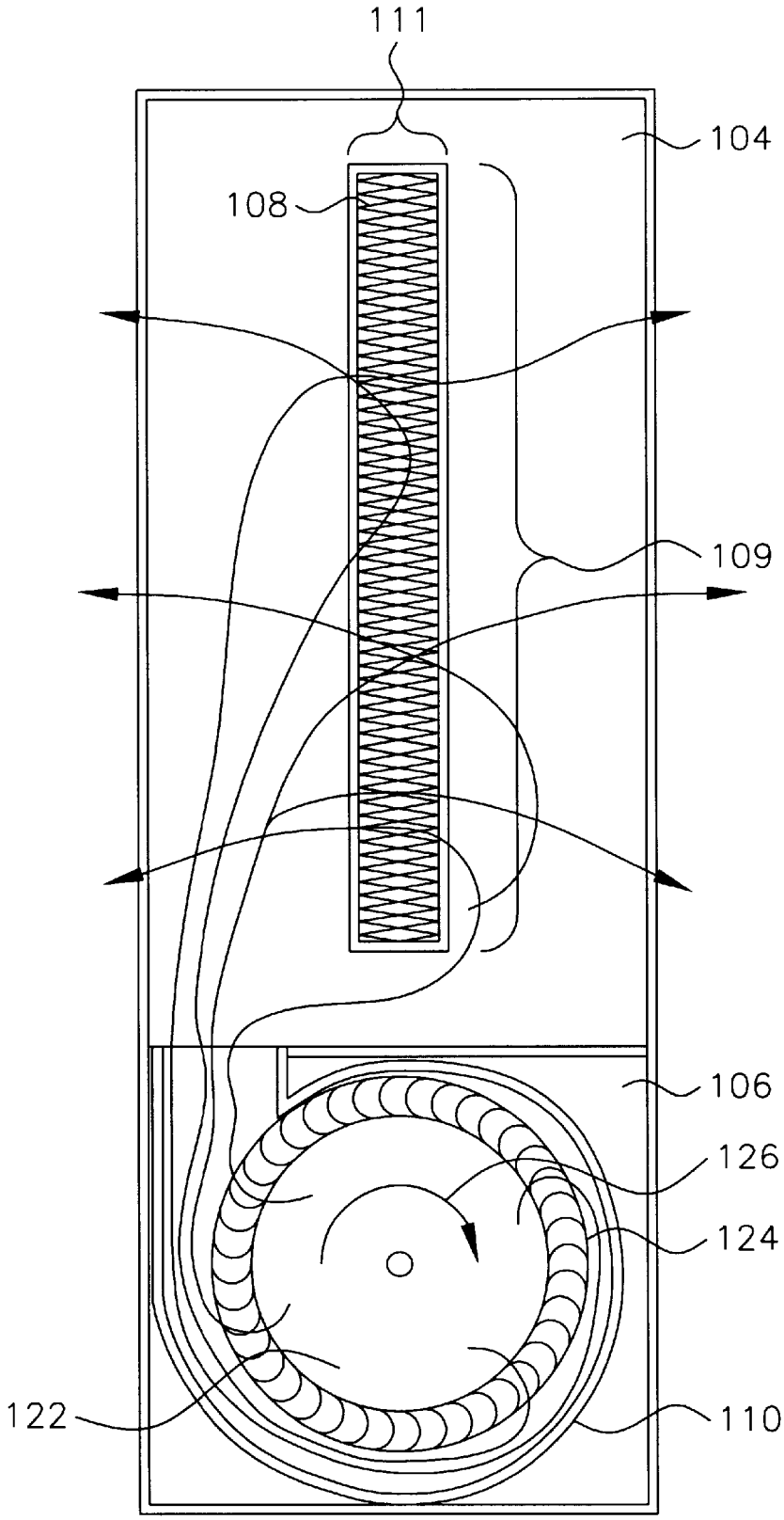

A first exemplary embodiment of the present invention is shown FIG. 1. As shown in FIGS. 1, 2A and 2B, heater 100 has a generally elongate configuration and includes a housing 102 defining a first interior space 104 and a second interior space 106. Enclosed within housing 102 is at least one electric heating element 108 having length 109 and width 111 (best shown in FIG. 2B). In one exemplary embodiment, length 109 is at least seven (7) inches, and may be a long as 30 inches, as desired. Heating element 108 may be a ceramic (positive temperature coefficient (PTC)) heating element or a resistive heating element (hot wire), for example. In one exemplary embodiment, heating element 108 is capable of generating up to about 1500 watts of energy. Although a single heating element 108 is shown in FIG. 1, the invention is not so limited. It is also contemplated that heating element 108 may also be two or more heating elements arranged in any desired configuration, such as end-to-end and/or side-by-side. In such an arrangement, the power generated by the two or more heating elements may be up to about 1500 watts. The invention is not so limited, however, and it is contemplated that energy in excess of 1500 watts may be generated, as desired.

The elongate configuration of heater 100 allows for heating element 108 to have a significant length 109 to width 111 ratio (aspect ratio). In one exemplary embodiment, the aspect ratio is greater that 4:1, preferably between 4:1 and 22:1, and most preferably about 18:1.

Within the second interior space 106 is air circulator 110, such as a blower. In one exemplary embodiment, air circulator 110 is a non-transverse blower. As shown in FIG. 1, air circulator 110 is adjacent first interior space 104. In this embodiment, the positioning of interior space 106 and air circulator 110 with respect to interior space 104 creates a plenum 105 between air circulator 110 and heating element 108. As a result, air circulator 110 receives intake air 112 entering housing 102 along first flow path 114, which enters interior 115 of fan blade 122 and generates exhaust air 116 along second flow path 118 within plenum 105. As shown, second flow path 118 is substantially orthogonal to first flow path 114.

Referring now to FIGS. 2A and 2B, air circulator 110 may have at least one fan blade 122, and preferably two or more blades, each having a plurality of blade elements 124 which face in a rotational direction 126 of air circulator 110.

Exhaust air 116 charges plenum 105 with a static pressure which then flows through heating element 108 at a substantially constant velocity. In one exemplary embodiment of the present invention, the air velocity is in excess of 375 feet per minute (FPM) as measured at one (1) foot from heating element 108. An additional benefit of the exemplary embodiment, is that exhaust air 116 flows through substantially all of heating element 108, thus providing more even heating in the space in which heater 100 is placed thereby increasing the comfort level of the user.

Figure 5A:
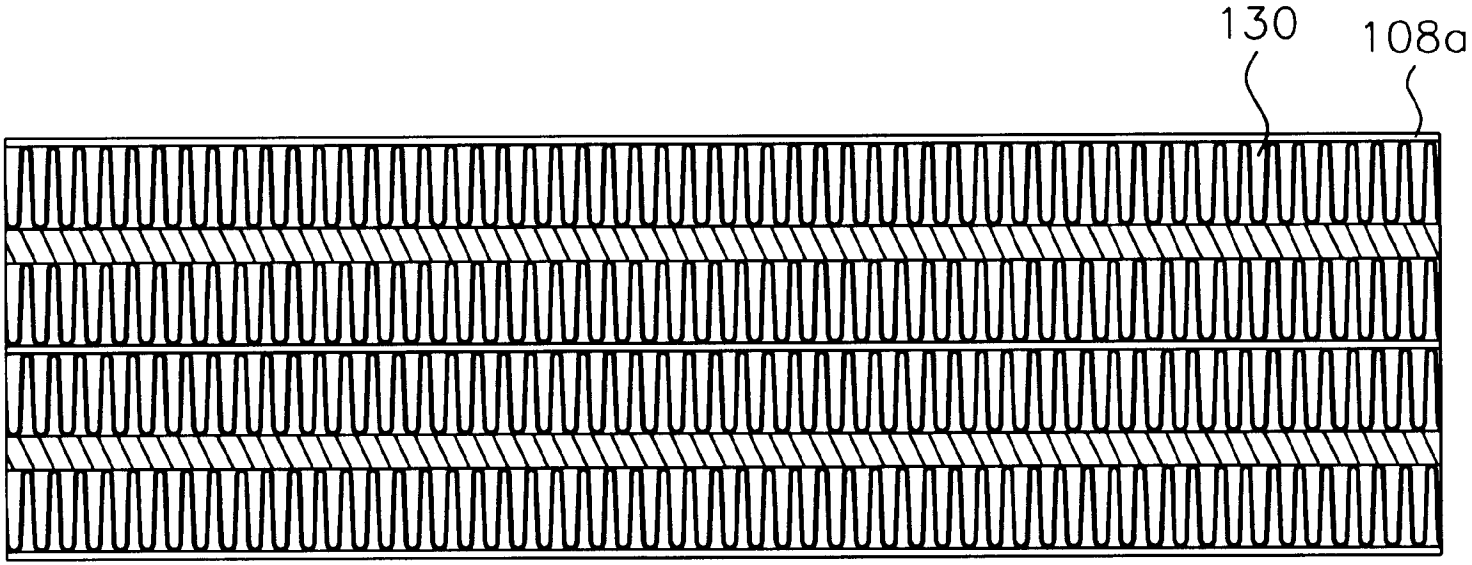
FIGS. 5A and 5B are illustrations of exemplary restrict means according to the present invention.
Figure 5B:
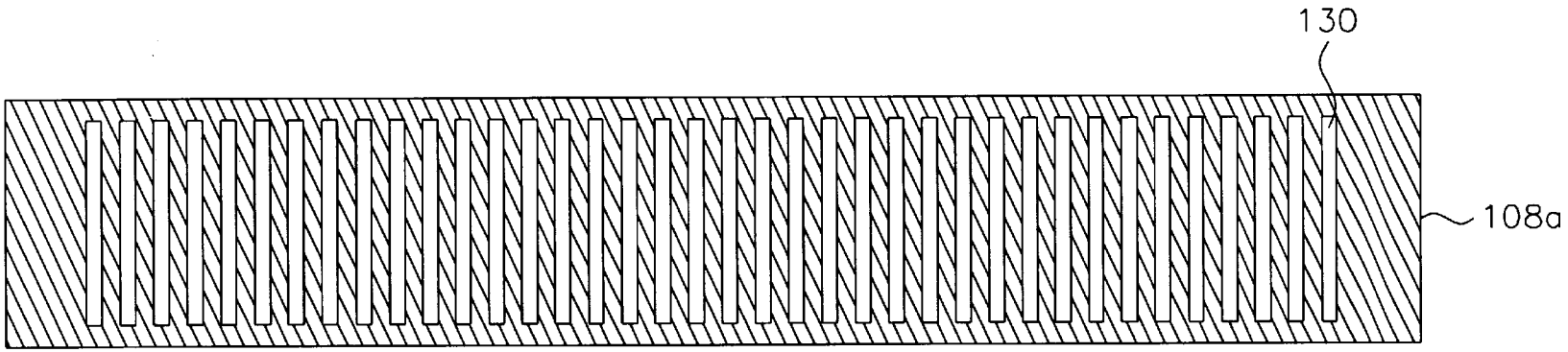
Figure 5C:
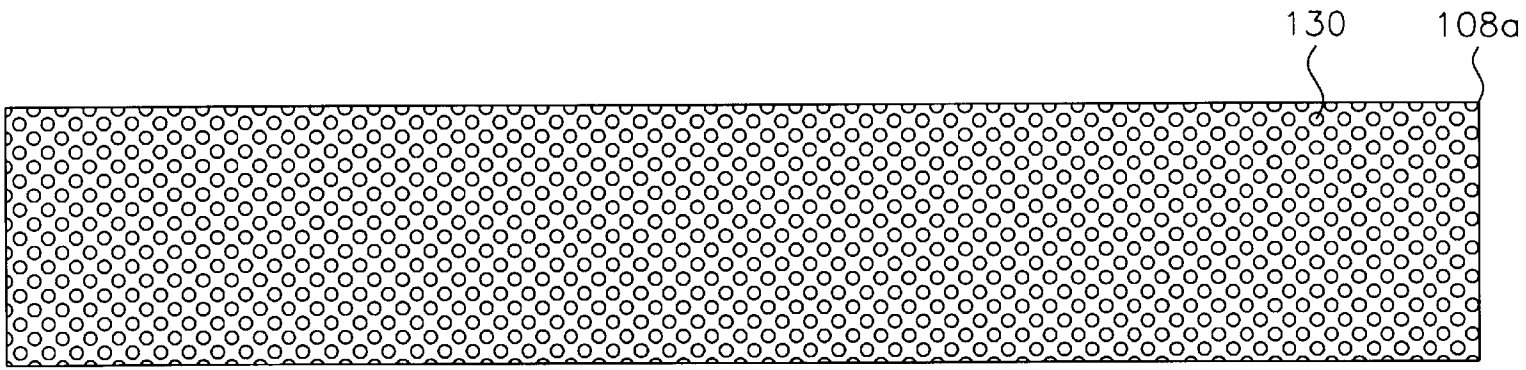
Figure 6:
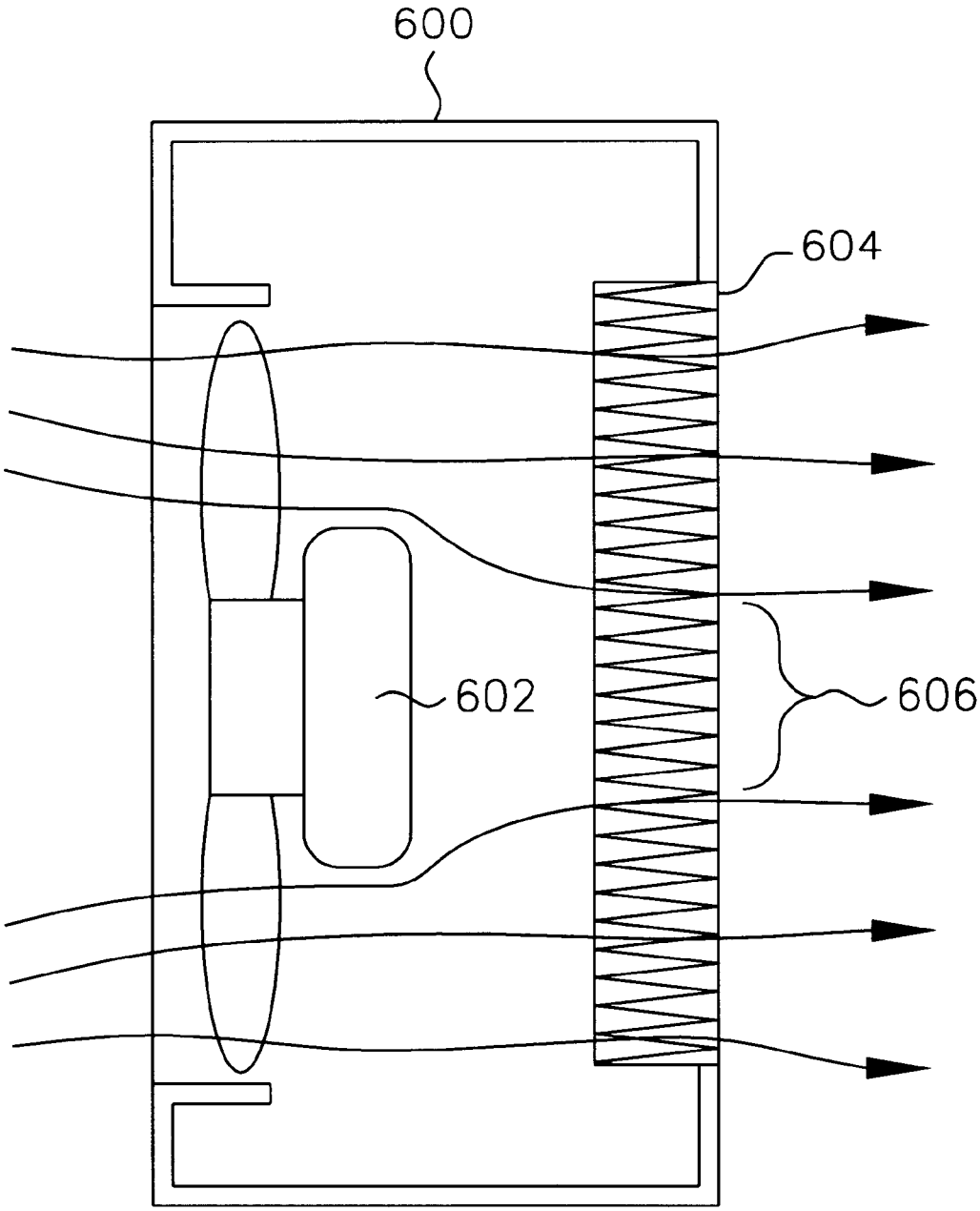
FIG. 6 (Prior Art)
FIG. 6 is a cross-sectional view of a conventional heater.
Figure 7:
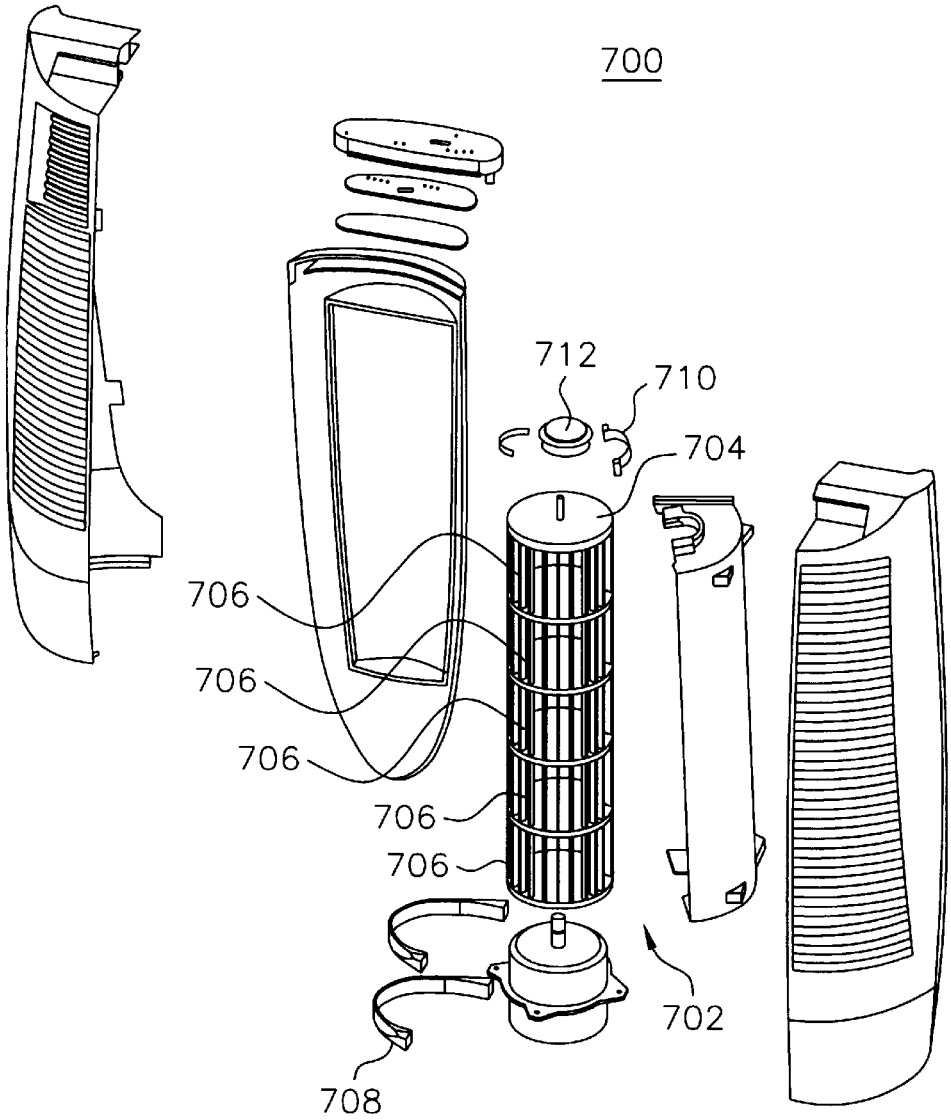
FIG. 7 (Prior Art)
FIG. 7 is a partial exploded view of another conventional heater.

According to one exemplary embodiment of the present invention, heating element 108 has a restrictor 108*a* and/or 108*b* formed adjacent a surface of heating element 108 which acts to restrict the flow of exhaust air 116 through heating element 108. The use of restrictor 108*a*, 108*b* converts the static pressure formed within plenum 105 into an air velocity. Restrictor 108*a*, 108*b* may be formed on one or both of the inlet side or outlet side of heating element 108, and may be either a part of or separate from heating element 108. Exemplary restrictors 108*a*, 108*b* are shown in FIGS. 5A–5C. As shown, restrictor 108*a*, 108*b* have a flow through (unobstructed) area 130 of between 20% and 80%, and preferably about 62% of total surface area.

According to an exemplary embodiment of the present invention, the static pressure developed within plenum 105 is greater than 0.01 inch water column, and preferably at least 0.05 inch water column, and most preferably may range between 0.07 and 0.22 inch water column.

According to one exemplary embodiment of the present invention, the ratio of length 109 of heating element 108 to blade diameter 111 of air circulator 110 is at least 1.75:1, and preferably at least 2.0:1. Further, although the exemplary embodiment of FIG. 1 illustrates a vertically configured apparatus, the invention is not so limited. It is also contemplated that this embodiment may be configured in a horizontal configuration if desired.

Figure 3A:
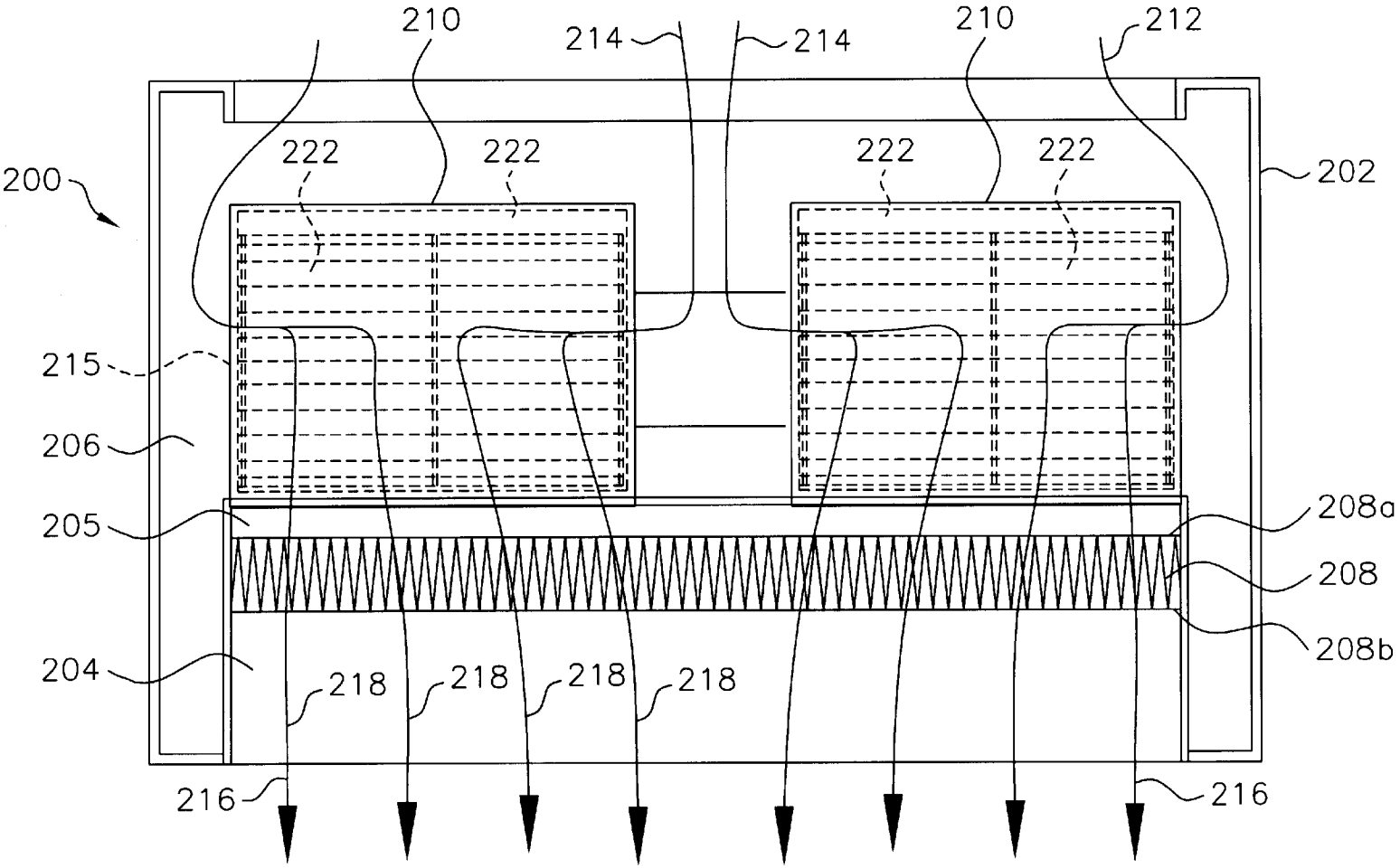
FIGS. 3A–3C are various cross-sectional views of a second exemplary embodiment of the present invention.
Figure 3B:
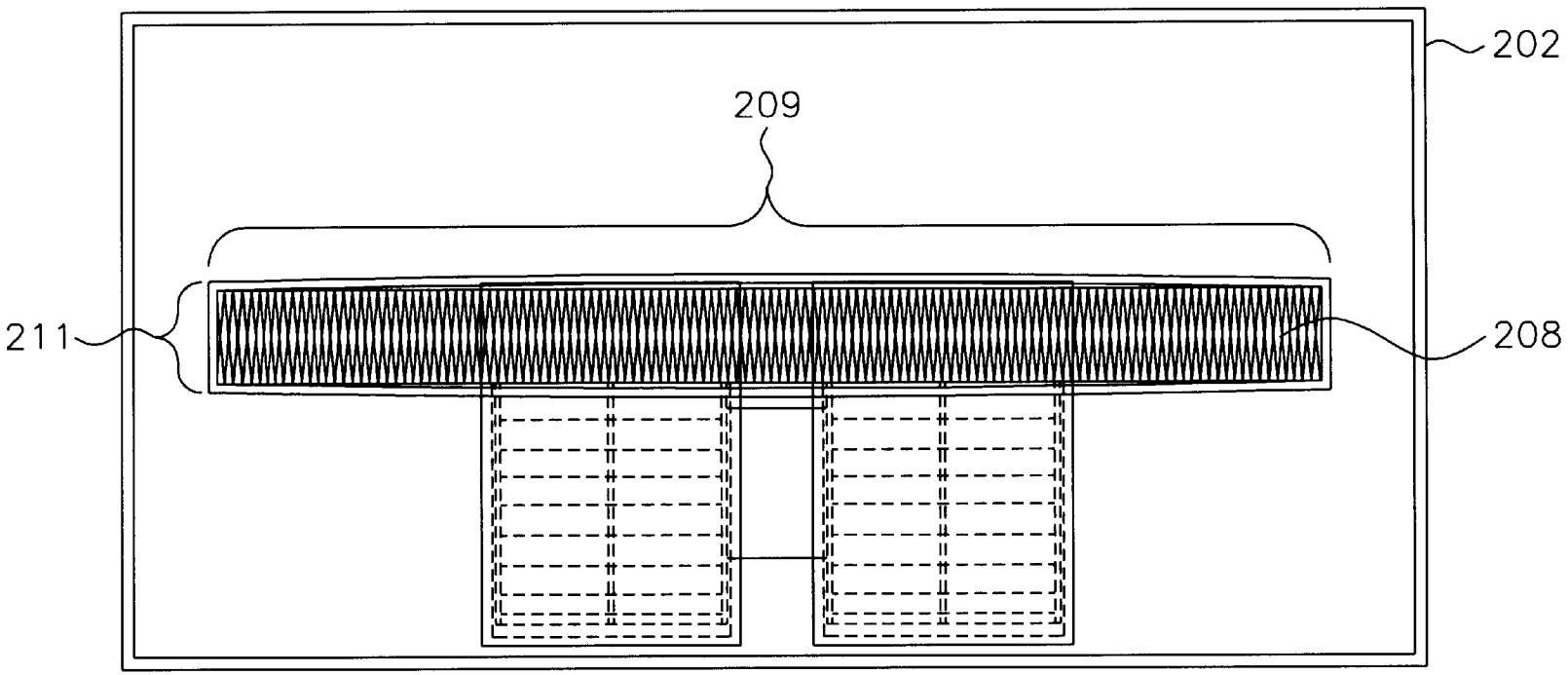
Figure 3C:
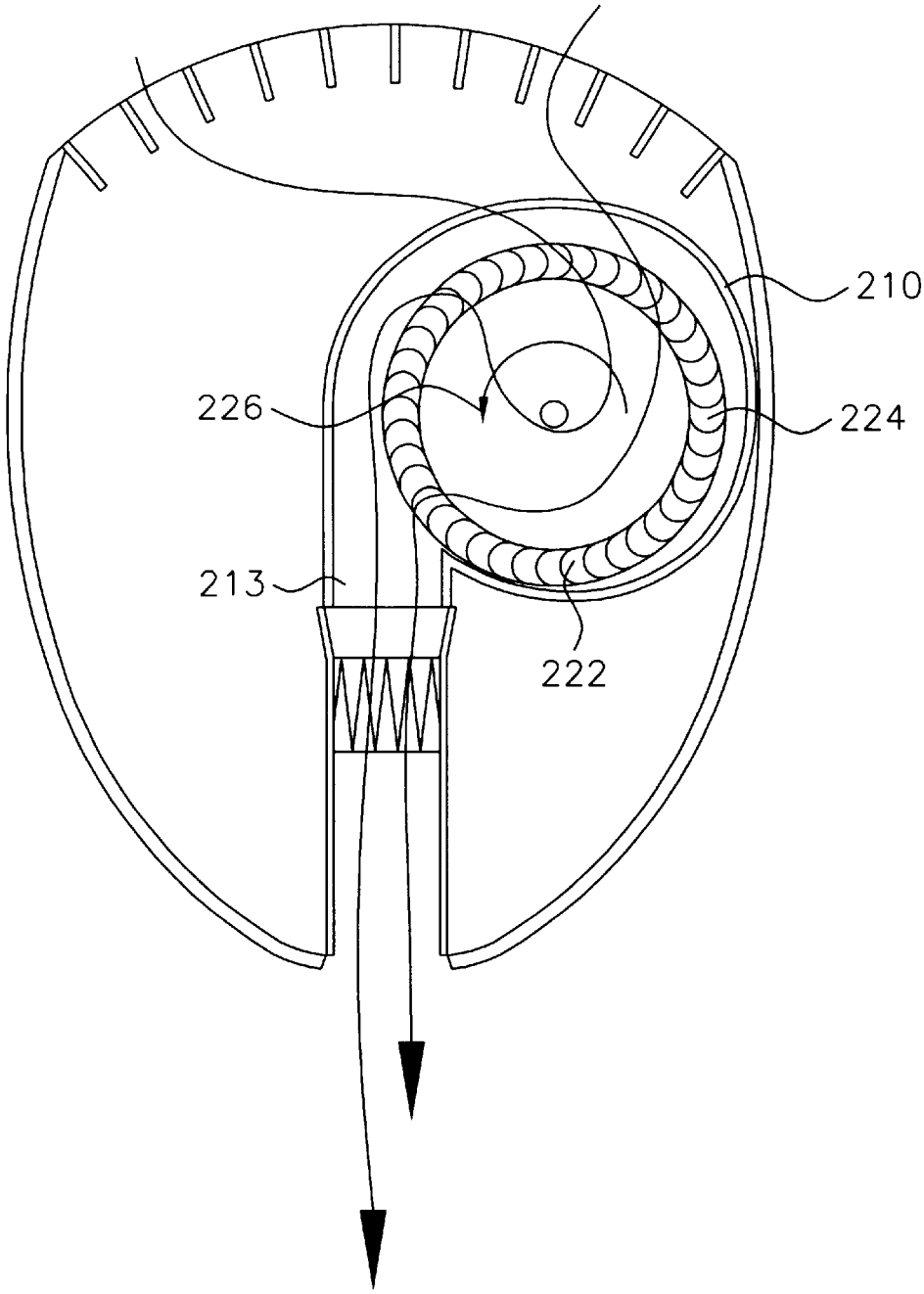

Referring now to FIGS. 3A–3C, a second exemplary embodiment of the present invention is shown. As best shown in FIG. 3B, heater 200 has a generally elongate configuration and includes housing 202 defining a first interior space 204 and a second interior space 206. Enclosed within housing 202 is at least one electric heating element 208 having length 209 and width 211. In one exemplary embodiment, length 209 is at least seven (7) inches, and may be a long as 30 inches, as desired. Similar to the first exemplary embodiment, heating element 208 may be at least one ceramic (positive temperature coefficient (PTC)) heating element or resistive heating element (hot wire), for example, arranged as desired to have an aspect ratio greater that 4:1, preferably between 4:1 and 22:1, and most preferably about 18:1.

Air circulator 210 is placed behind first interior space 204 such that output port 213 of air circulator 210 is coupled to plenum 205 which is formed between air circulator 210 and heating element 208. Air circulator 210 receives intake air 212 entering housing 202 along first flow path 214, which enters interior 215 of fan blades 222 and generates exhaust air 216 along second flow path 118 within plenum 205.

Referring now to FIGS. 3C, air circulator 210, such as a blower assembly, may also have at least one fan blade 222, and preferably two or more blades, each having a plurality of blade elements 224 which face in a rotational direction 226 of air circulator 210.

Similar to the first exemplary embodiment, exhaust air 216 charges plenum 205 with a static pressure which then flows through heating element 208 at a substantially constant velocity. In one exemplary embodiment of the present invention, the air velocity is in excess of 375 feet per minute (FPM) as measured at one (1) foot from heating element 208. An additional benefit of the exemplary embodiment is that exhaust air 216 flows through substantially all of heating element 108, thus providing more even heating in the space in which heater 200 is placed.

Heating element 208 also has a restrictor 208*a* and/or 208*b* formed adjacent a surface of heating element 208 which acts to restrict the flow of exhaust air 216 through heating element 208. The use of restrictor 208*a*, 208*b* converts the static pressure formed within plenum 205 into an air velocity. Restrictor 208*a*, 208*b* may be formed on one or both of the inlet side or outlet side of heating core 208, and may be either a part of or separate from heating element 208. Similar to the first exemplary embodiment, restrictor 208*a*, 208*b* have a flow through (unobstructed) area of between 20% and 80%, and preferably about 62% of total surface area.

According to this exemplary embodiment, the static pressure developed within first interior space 104 is greater than 0.01 inch water column, and preferably at least 0.05 inch water column, and most preferably may range between 0.07 and 0.22 inch water column. In addition, the ratio of the length 209 of heating element 208 to the diameter of fan blade 222 incorporated in air circulator 210 is at least 1.75:1, and preferably at least 2.0:1.

Figure 4A:
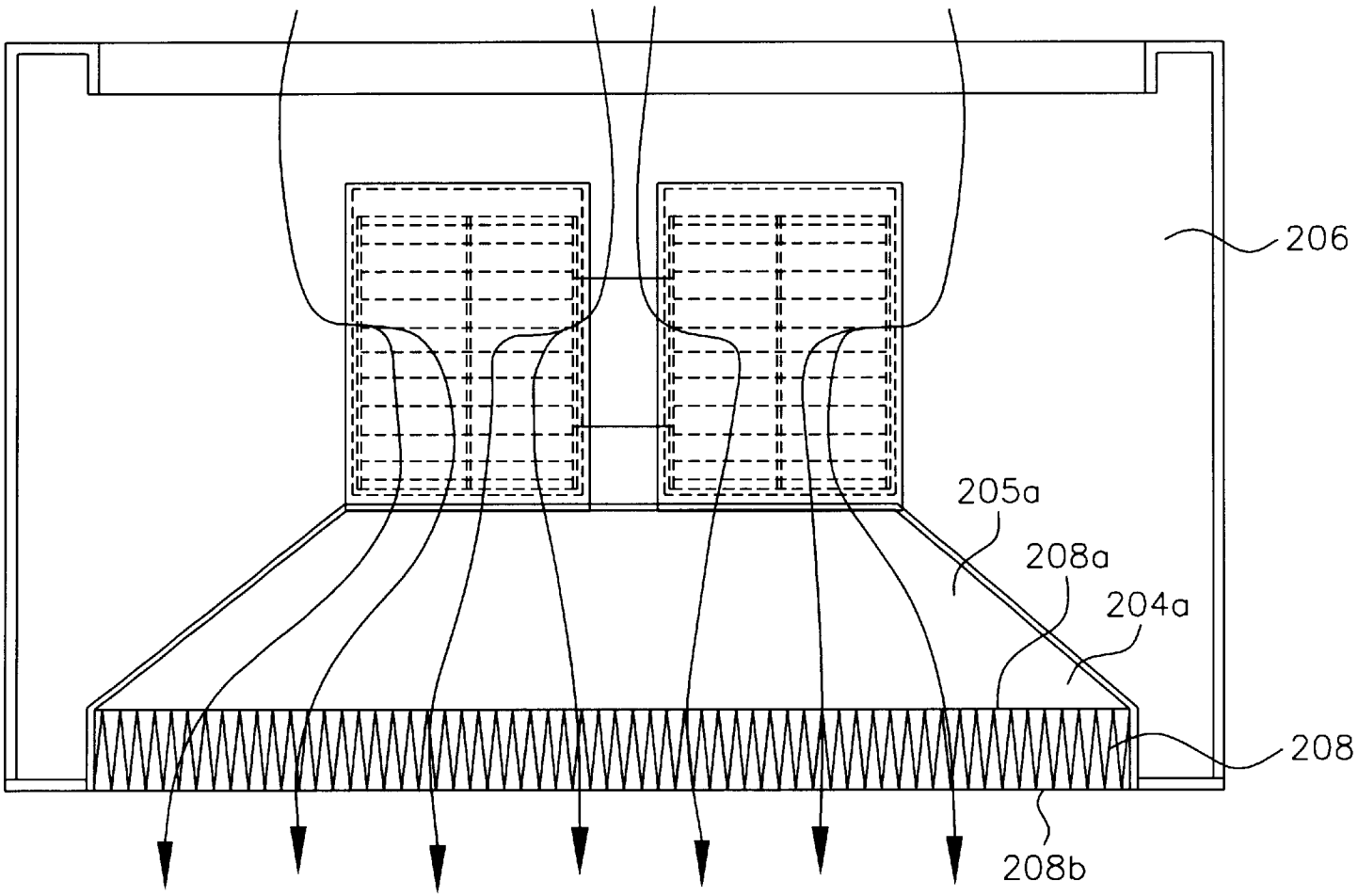
FIGS. 4A–4C are various cross-sectional views of a third exemplary embodiment of the present invention.
Figure 4B:
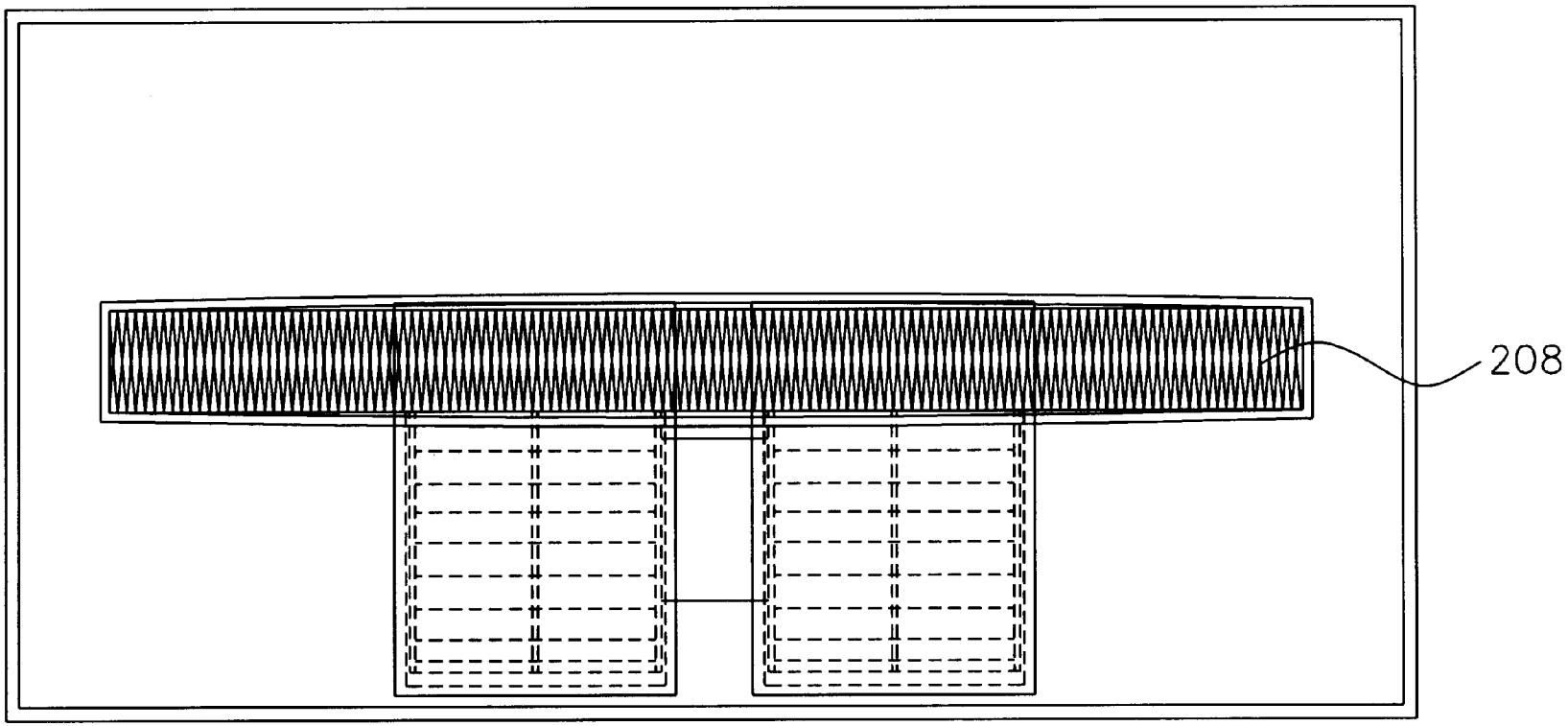
Figure 4C:
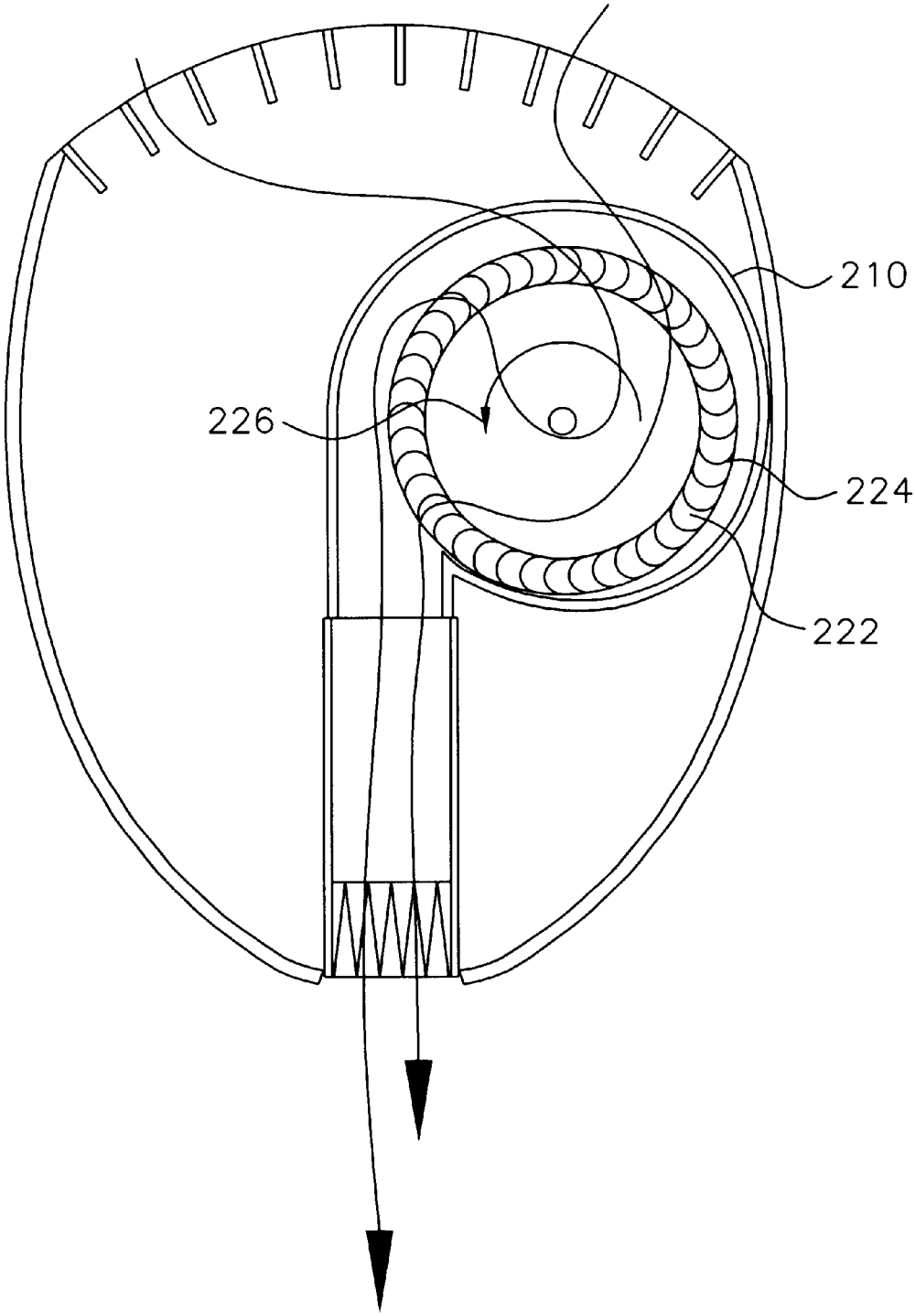

Referring now to FIGS. 4A–4C, a third exemplary embodiment of the present invention is shown. This exemplary embodiment is similar to the second exemplarity embodiment except that heating element 208 is spaced further away from air circulator 210, thereby forming a larger plenum area 205*a*. In all other respects, the second and third exemplary embodiments are similar, and therefore the above detailed description is not repeated.

Figure 4D:
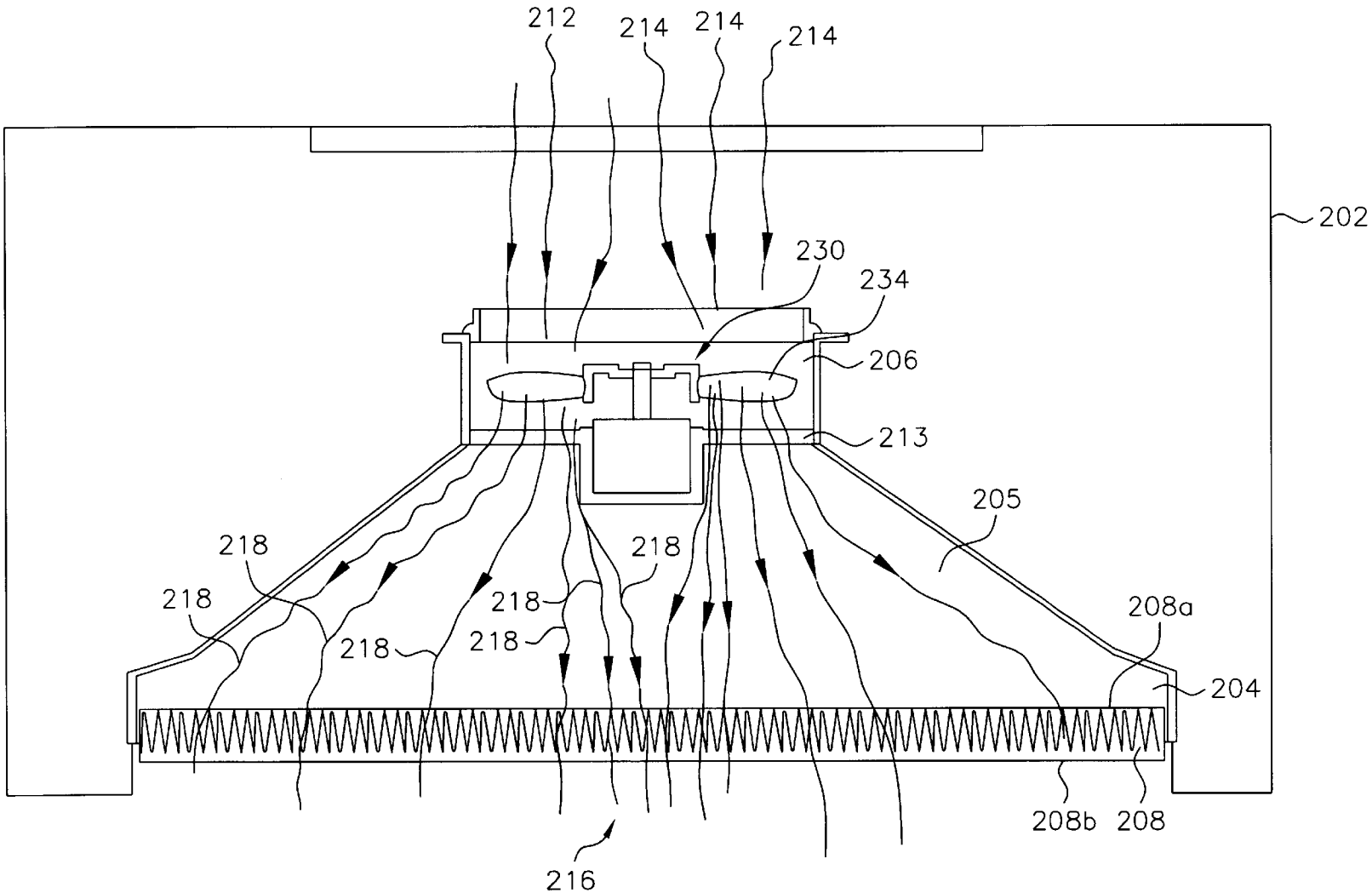
FIGS. 4D–4E are various cross-sectional views of a fourth exemplary embodiment of the present invention.
Figure 4E:
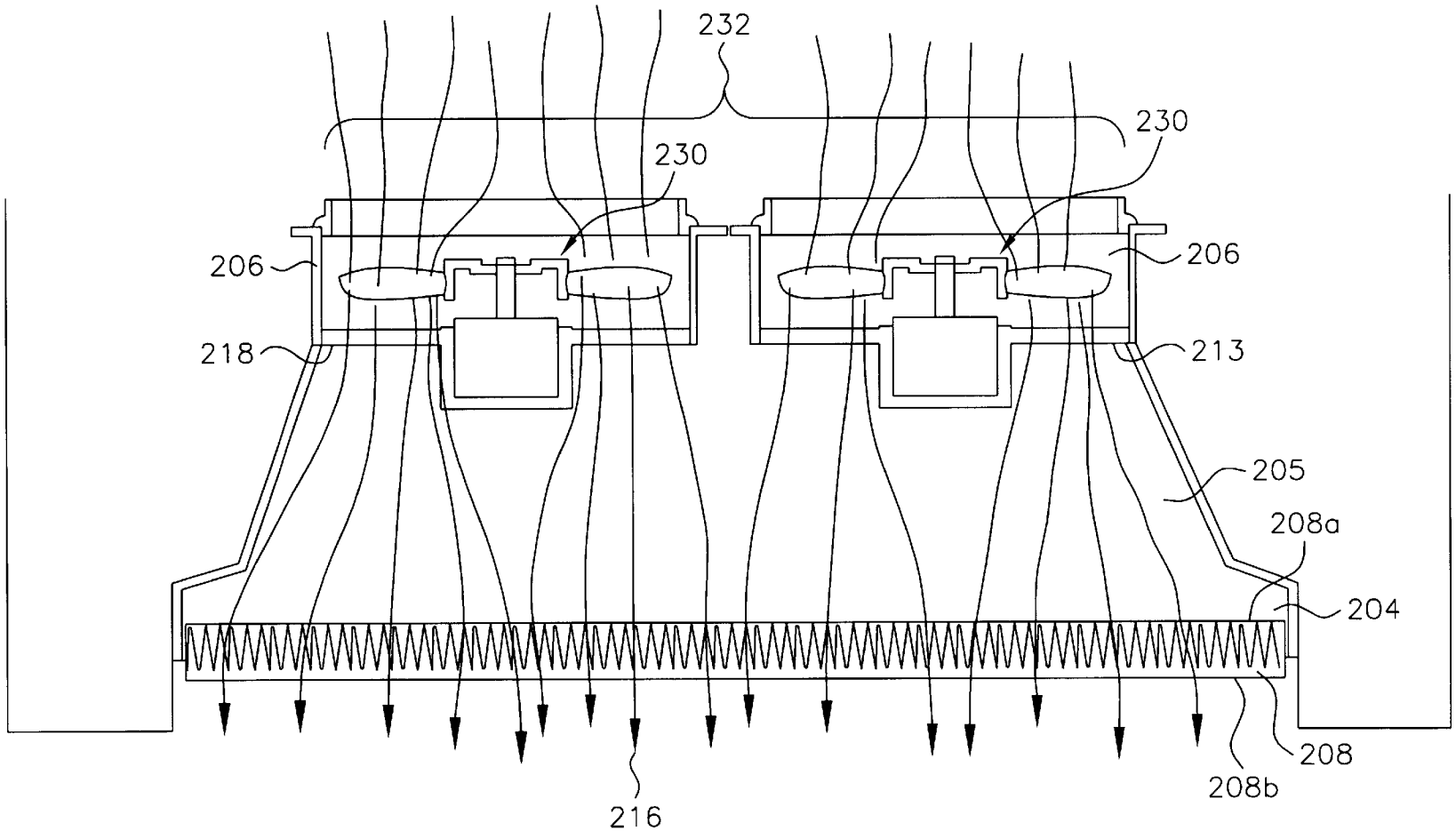

Referring now to FIGS. 4D and 4E, a fourth exemplary embodiment of the present invention is shown in which the air circulator may be comprised of at least one axial fan assembly 230, and preferably (as shown in FIG. 4E) two or more axial fans 230 contained within a common structure 232, coupled to plenum 205. Air circulator 230 receives intake air 212 entering housing 202 along first flow path 214, which enters the rear of fan blades 234 and generates exhaust air 216 along second flow path 118 which charges plenum 205 with static pressure.

Figure 4F:
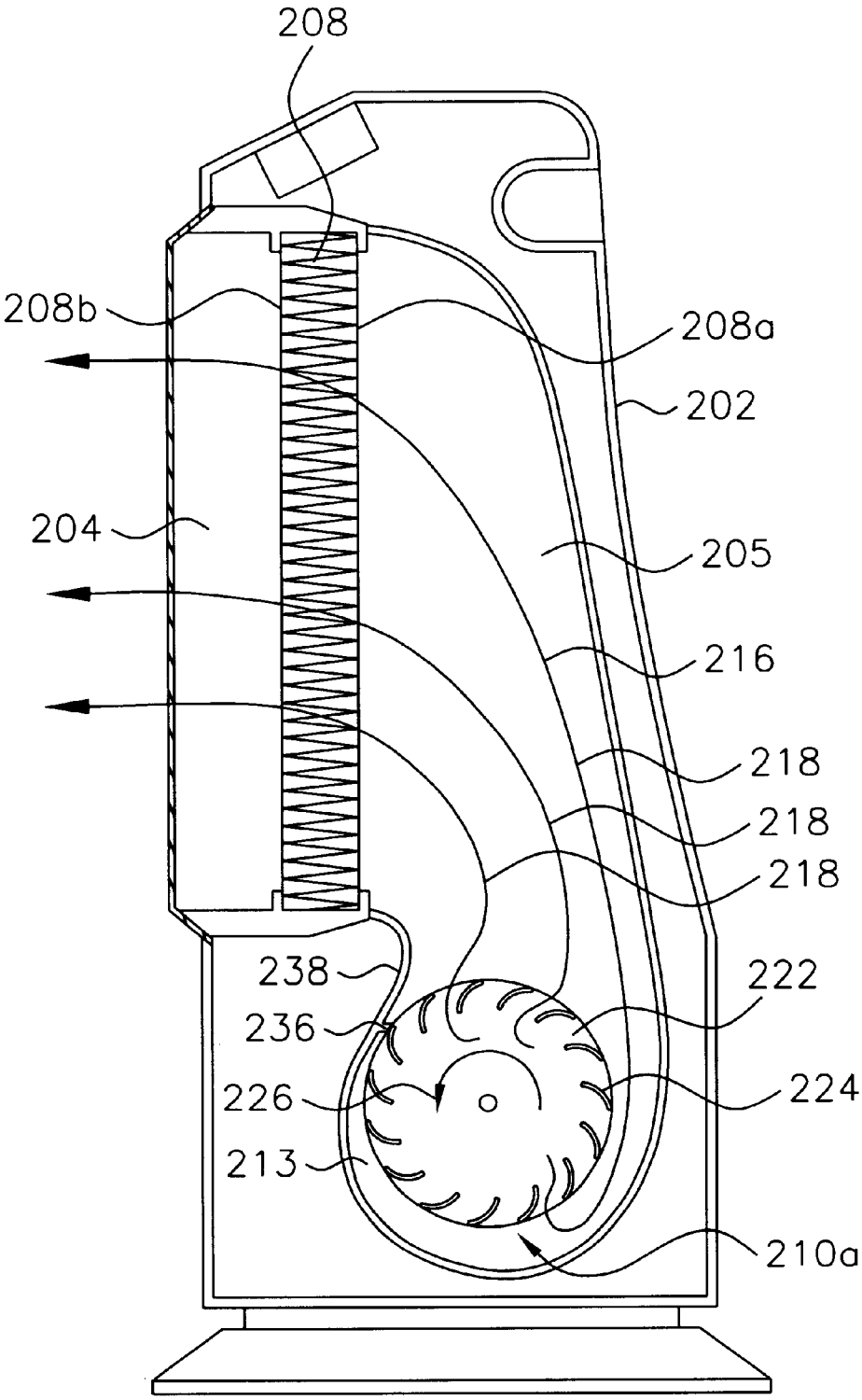
FIGS. 4F–4G are cross sectional views of a fifth exemplary embodiment of the present invention.
Figure 4G:
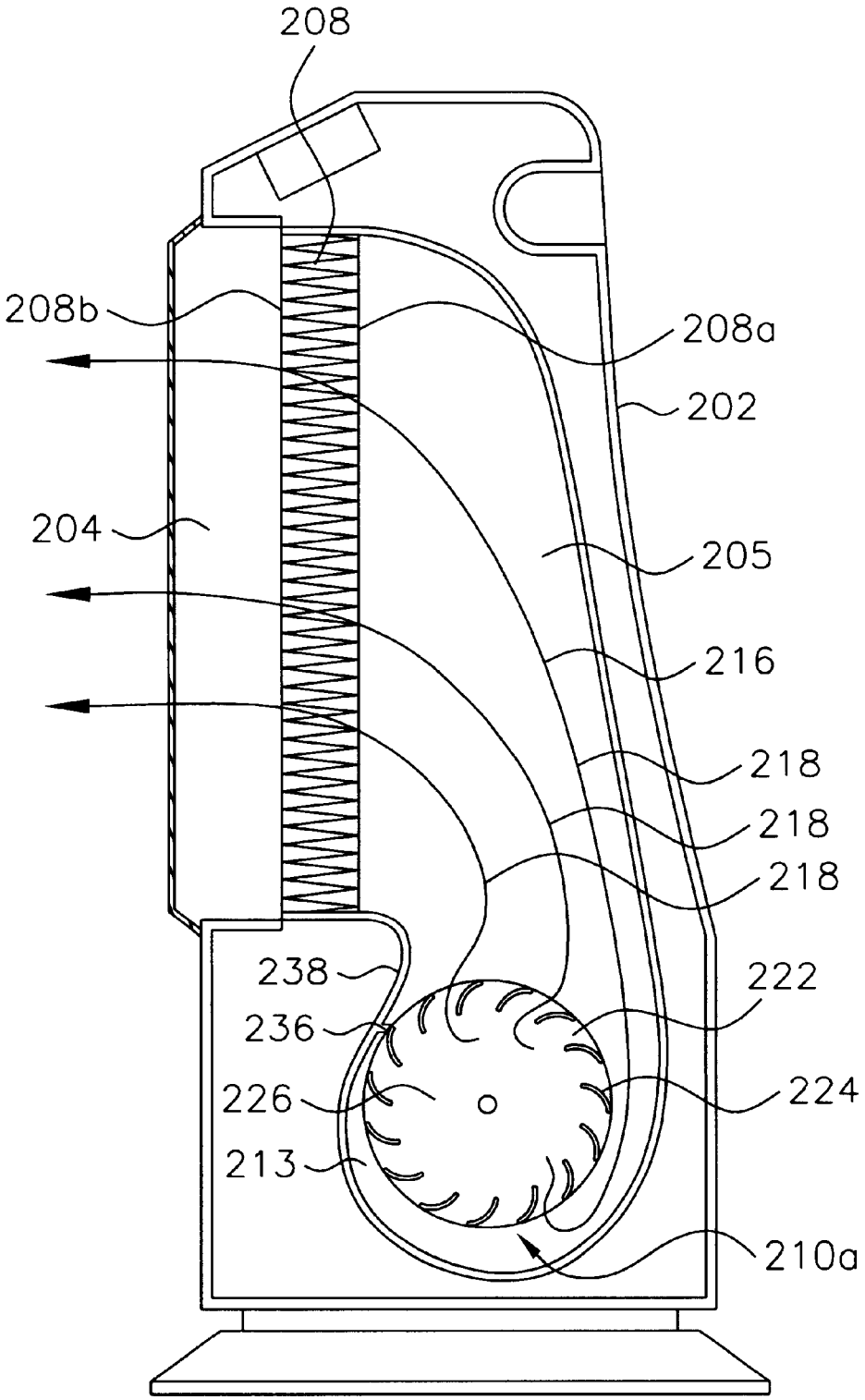

Referring now to FIGS. 4F and 4G, a fifth exemplary embodiment of the present invention is shown. In FIGS. 4F and 4G, air circulator 210*a* is placed below heating element 208 such that output port 213 of air circulator 210*a* is coupled to plenum 205 which is formed between air circulator 210*a* and heating element 208. Air circulator 210*a* receives intake air (best shown in FIG. 2A) entering housing 202 along a first flow path (not shown in this figure), which in turn enters fan blade 222 and generates exhaust air 216 along second flow path 218, substantially orthogonal to the first flow path, within plenum 205, which charges plenum 205 with static pressure.

As shown in FIGS. 4F and 4G, fan blade elements 224 of fan blade 222, face in a direction opposite to a rotational direction 226 of air circulator 210*a*. Further, air stop 236 is formed along wall 238 to assist in concentrating exhaust air 216 along output port 213 and to assist in preventing a return of exhaust air 216 back into fan blade 222. Also, in FIG. 4F, heating element 208 is position adjacent the upper portion of plenum 205 and within first interior space 204, whereas in FIG. 4G heating element 208 is position the within upper portion of plenum 205 and adjacent first interior space 204.

In one exemplary embodiment, heaters 100, 200 may further include a vent, such as louvers 132 formed adjacent heating element 108/208, for venting the exhaust air from heating element 108/208. In one exemplary embodiment, the vent may include an oscillator device, such as a motor (not shown), for moving the vent in one or both of the vertical direction and/or the horizontal direction to redirect and spread the exhaust air through the space in which the heater is located. In another exemplary embodiment, heater 100 may include a device, such as motor 134, coupled to base 136 of housing 102 to redirect and spread the exhaust air through the space in which the heater 100 is located.

Although the invention has been described with reference to exemplary embodiments, it is not limited thereto. Rather, the appended claims should be construed to include other variants and embodiments of the invention, which may be made by those skilled in the art without departing from the true spirit and scope of the present invention.

What is claimed:

1. An apparatus for providing thermal energy for use in a household environment, the apparatus comprising:

a portable free standing elongate housing defining i) a first interior space having a vertically oriented elongate configuration, ii) a second interior space, the second interior space positioned below the first interior space, iii) a vertically oriented elongate air outlet disposed adjacent the first interior space at a portion of the housing, and iv) at least one air inlet disposed adjacent the second interior space;

at least one vertically oriented elongate electric heating element positioned within the first interior space, the at least one vertically oriented elongate electric heating element oriented along a length of the first housing;

a non-transverse centrifugal blower positioned within the second interior space and in fluid communication with the first interior space, the non-transverse centrifugal blower having at least one intake port receiving intake air from a first flow path at a lower portion of the housing and generating exhaust air upward along a second flow path, the second flow path substantially orthogonal to the first flow path; and a vertical oriented elongate restrictor positioned within the first interior space for restricting a flow of the exhaust air through the at least one vertically oriented elongate electric heating element, wherein substantially all the exhaust air flows through the at least one vertically oriented elongate heating element in a substantially uniform direction and is exhausted above the first flow path.

2. The apparatus according to claim 1, wherein the non-transverse centrifugal blower has a predetermined blade diameter and the at least one vertically oriented elongate heating element has a predetermined length, and a ratio of the at least one vertically oriented elongate heating element length to the blade diameter is at least 1.75:1.

3. The apparatus according to claim 1, wherein the non-transverse centrifugal blower has at least one fan blade having a plurality of blade elements facing in a rotational direction of the non-transverse centrifugal blower.

4. The apparatus according to claim 1, wherein a static pressure within the first interior space is greater than 0.01 inch water column.

5. The apparatus according to claim 1, wherein a static pressure within the first interior space is at least 0.05 inch water column.

6. The apparatus according to claim 1, wherein an aspect ratio of the at least one vertically oriented elongate heating element is greater than 4:1.

7. The apparatus according to claim 1, wherein an aspect ratio of the at least one vertically oriented elongate heating element is about 18:1.

8. The apparatus according to claim 1, wherein an aspect ratio of the at least one vertically oriented elongate heating element is between about 4:1 and 22:1.

9. The apparatus according to claim 1, wherein a single heat distribution pattern is generated which is substantially continuous over a substantial length of the apparatus.

10. The apparatus according to claim 1, wherein only a single elongate path of heat is provided from the housing.

11. The apparatus according to claim 1, wherein the second flow path comprises at least two flow path portions exhausting from respective outlets of the air generator, the at least two flow path portions combining into the second flow path.

12. The apparatus according to claim 1, wherein the at least one heating element generates a total of about 1500 Watts of energy.

13. The apparatus according to claim 1, wherein the restrictor is a unitary part of the at least one vertically oriented elongate electric heating element.

14. The apparatus according to claim 1, wherein the at least one vertically oriented elongate electric heating element is a ceramic heating element.

15. An apparatus for providing thermal energy for use in a household environment, the apparatus comprising:

a portable free standing housing defining at least a first interior space having a vertically oriented elongate configuration;

at least one vertically oriented elongate electric heating element positioned within the first interior space and oriented along a length of the housing; and a non-transverse centrifugal blower positioned within the housing and in fluid communication with the first interior space, the non-transverse centrifugal blower generating exhaust air for charging the first interior space with a static pressure; and a vertically oriented elongate restrictor positioned within the first elongate interior space for i) converting the static pressure into an airflow having a velocity and ii) restricting a flow of the exhaust air through the at least one vertically oriented elongate electric heating element, wherein substantially all the exhaust air flows through the at least one vertically oriented elongate electric heating element in a substantially uniform direction and along a substantial portion of the length of the at least one vertically oriented elongate electric heating element.

16. The apparatus according to claim 15, wherein the non-transverse centrifugal blower is directly coupled to the first interior space.

17. The apparatus according to claim 15, wherein a the non-transverse centrifugal blower is a unitary blower assembly.

18. The apparatus according to claim 15, wherein the non-transverse centrifugal blower has an elongate structure having a vertical orientation.

19. The apparatus according to claim 15, wherein the first interior space further includes a plenum area between the vertically oriented elongate electric heating element and the non-transverse centrifugal blower.

20. The apparatus according to claim 15, wherein the non-transverse centrifugal blower has at least one intake port, the at least one intake port receiving intake air along a first flow path, and generating the exhaust air along a second flow path, the second flow path substantially orthogonal to the first flow path.

21. The apparatus according to claim 15, wherein the housing further defines a second interior space adjacent the interior space, the non-transverse centrifugal blower located within the second interior space.

22. The apparatus according to claim 15, wherein the static pressure within the first interior space is greater than 0.01 inch water column.

23. The apparatus according to claim 15, wherein the static pressure within the first interior space is greater than 0.06 inch water column.

24. The apparatus according to claim 15, wherein the pressure within the interior space is between about 0.07" and 0.22 inch water column.

25. The apparatus according to claim 15, wherein the non-transverse centrifugal blower has a predetermined blade diameter and the at least one vertically oriented elongate electric heating element has a predetermined length, a ratio of the heating element length to the non-transverse centrifugal blower blade diameter being at least 1.75:1.

26. The apparatus according to claim 15, wherein the non-transverse centrifugal blower has a predetermined blade diameter and the at least one vertically oriented elongate electric heating element has a predetermined length, a ratio of the heating element length to the non-transverse centrifugal blower blade diameter being at least 2:1.

27. The apparatus according to claim 15, wherein the velocity is greater than 375 fpm at 1 foot from the at least one vertically oriented elongate electric heating element.

28. The apparatus according to claim 15, wherein the restricting means is a unitary part of the at least one vertically oriented elongate electric heating element.

29. The apparatus according to claim 15, wherein the at least one vertically oriented elongate electric heating element has an input side and an output side, the restricting means adjacent to at least one of the input side and the output side of the heating element.

30. The apparatus according to claim 15, wherein the restricting means is separate from the at least one vertically oriented elongate electric heating element.

31. The apparatus according to claim 15, wherein the restricting means has a flow through area of between 20% and 80%.

32. The apparatus according to claim 15, wherein the restricting means has a flow through area of about 62%.

33. The apparatus according to claim 15, wherein the restricting means converts the static pressure associated with the exhaust air into an air velocity which is in turn imparted into the exhaust air and flows through the at least vertically oriented elongate electric one heating element.

34. The apparatus according to claim 15, wherein the at least one vertically oriented elongate electric heating element has a length of at least 7 inches.

35. The apparatus according to claim 15, wherein the non-transverse centrifugal blower is positioned alongside the at least one vertically oriented elongate electric heating element.

36. The apparatus according to claim 15, wherein the non-transverse centrifugal blower is at least one of i) positioned behind the at least one vertically oriented elongate electric heating element and ii) has an axis of rotation parallel to a longitudinal axis of the vertically oriented elongate electric heating element.

37. The apparatus according to claim 15, wherein the at least one vertically oriented elongate electric heating element is a ceramic heating element.

38. The apparatus according to claim 15, wherein the at least one vertically oriented elongate electric heating element is an electrical resistive heating element.

39. The apparatus according to claim 15, further comprising vent means for venting the exhaust air from the at least one vertically oriented elongate electric heating element.

40. The apparatus according to claim 10, wherein the non-transverse centrifugal blower emits a concentrated airflow toward the at least one vertically oriented elongate electric heating element.

41. The apparatus according to claim 10, wherein the vertically oriented elongate electric heating element has a predetermined length and a predetermined width, an aspect ratio of the predetermined length to the predetermined width being at least 4:1.

42. The apparatus according to claim 41, wherein the aspect ratio is about 18:1.

43. The apparatus according to claim 41, wherein the aspect ratio is between about 4:1 and 22:1.

44. An apparatus for providing thermal energy for use in a household environment, the apparatus comprising:

a portable free standing housing means defining a first elongate interior space and a second interior space;

vertically oriented elongate thermal energy generation means for generating thermal energy, the thermal energy generation means positioned i) within the first elongate interior space and oriented along a length of the first elongate interior space and ii) above the second interior space; and non-transverse centrifugal blower means for generating an exhaust airflow toward the first interior space, the non-transverse centrifugal blower means positioned within the second interior space and coupled to the first interior space, wherein the air generation means receives intake air from a first flow path at a lower portion of the housing means and generates the exhaust air along a second flow path, the second flow path substantially orthogonal to the first flow path and directed away from the first flow path, substantially all the exhaust air flowing through the vertically oriented elongate thermal energy generation means in a substantially uniform direction and exiting the housing means above the first flow path.

45. An apparatus for providing thermal energy for use in a household environment, the apparatus comprising:

portable free standing housing means defining at least a first interior space having a vertically oriented elongate configuration;

vertically oriented elongate thermal energy generation means for generating thermal energy, the thermal energy generation means positioned within the first interior space and having a length of at least 7 inches;

non-transverse centrifugal pressure generating means for generating a static pressure within the first interior space, the pressure generating means positioned within the housing and in direct fluid communication with the first interior space; and a restrictor positioned within the first interior space for converting the static pressure into an airflow and restricting a flow of exhaust air through the thermal energy generation means, wherein the pressure generating means has a predetermined blade diameter and the thermal energy generation means has a predetermined length, a ratio of the thermal energy generation means length to the static pressure generating means blade diameter being at least 1.75:1, and substantially all the exhaust air flows through the thermal energy generation means in a substantially uniform direction and along a substantial portion of the length of the thermal energy generation means.

46. The apparatus according to claim 45, wherein the restrictor is a unitary part of the thermal energy generation means.

47. The apparatus according to claim 45, wherein the thermal energy generation means has a predetermined length and a predetermined width, an aspect ratio of the predetermined length to the predetermined width being at least 3:1.

48. A method for providing thermal energy for use in a household environment, the method comprising the steps of:

providing a portable free standing elongate housing having a first elongate interior space and a second interior space;

receiving at least a portion of intake air along a first flow path at other than a front portion of the housing at a lower area thereof;

generating an exhaust airflow toward the first interior space along a second flow path based on the intake air, the second flow path substantially orthogonal to the first flow path;

generating thermal energy within the first interior space using a vertically oriented elongate thermal energy generator;

imparting the thermal energy into the exhaust air by passing substantially all of the exhaust air though the vertically oriented elongate-thermal energy generator to form heated exhaust air; and expelling the heated exhaust air from the first interior space along a flow path above the first flow path and directed away from at least a portion the first flow path.

49. An apparatus for providing thermal energy for use in a household environment, the apparatus comprising:

a portable free standing housing defining i) a first interior space having a vertically oriented elongate configuration, ii) a second interior space, the second interior space positioned below the first interior space, iii) an air outlet disposed adjacent the first interior space at a front portion of the housing, and iv) at least one air inlet disposed adjacent the second interior space, one of the at least one air inlets other than at a front portion of the housing of the housing;

at least one vertically oriented elongate electric heating element positioned one of within and adjacent the first interior space, the at least one vertically oriented elongate electric heating element having a length of at least 7 inches and oriented along a length of the first housing;

a non-transverse centrifugal blower positioned within the second interior space and directly coupled to the first interior space at a lower portion thereof, the non-transverse centrifugal blower having at least one intake port receiving intake air traveling along a first flow path at a lower portion of the housing and generating exhaust air upward along a second flow path, the second flow path substantially orthogonal to the first flow path; and at least one air restrictor positioned adjacent the at least one vertically oriented elongate electric heating element to restrict a flow of the exhaust air through the heating element, wherein substantially all the exhaust air flows in a substantially uniform direction and through a substantial portion of the vertically oriented elongate electric heating element and is exhausted above the first flow path.

50. The apparatus according to claim 49, wherein a portion of the first interior space forms a plenum area between the at least one vertically oriented elongate electric heating element and the non-transverse centrifugal blower, the exhaust air charging at least the plenum area with a static pressure.

51. An apparatus for providing thermal energy comprising:

a housing defining a first interior space and a second interior space;

at least one vertically oriented elongate electric heating element positioned within the first interior space;

a non-transverse centrifugal blower positioned within the second interior space and adjacent the first interior space, the non-transverse centrifugal blower having at least one intake port receiving intake air from a first flow path and generating exhaust air along a second flow path, the second flow path substantially orthogonal to the first flow path; and a restrictor for restricting a flow of exhaust air through the at least one vertically oriented elongate electric heating element, wherein substantially all the exhaust air flows through the at least one vertically oriented elongate electric heating element in a substantially uniform direction along a substantial portion of the length of the heating element.

52. An apparatus for providing thermal energy for use in a household environment, the apparatus comprising:

a portable free standing elongate housing defining i) a first interior space having a vertically oriented elongate configuration, ii) a second interior space, the second interior space positioned below the first interior space, iii) a vertically oriented elongate air outlet disposed adjacent the first interior space at a front portion of the housing, and iv) at least one air inlet disposed adjacent the second interior space, one of the at least one air inlets other than at a front portion of the housing;

at least one vertically oriented elongate electric heating element positioned within the first interior space, the at least one vertically oriented elongate electric heating element oriented along a length of the first housing; and a non-transverse centrifugal blower positioned within the second interior space and coupled to a lower portion of the first interior space, the non-transverse centrifugal blower having at least one intake port receiving intake air from a first flow path at a lower portion of the housing and generating exhaust air upward along a second flow path, the second flow path substantially orthogonal to the first flow path, wherein substantially all the exhaust air flows through the at least one vertically oriented elongate heating element in a substantially uniform direction and is exhausted above the first flow path.

* * * * *